US011583741B2

(12) United States Patent
Newell

(10) Patent No.: US 11,583,741 B2
(45) Date of Patent: Feb. 21, 2023

(54) BATTING TRAINING SYSTEM

(71) Applicant: Christopher J. Newell, Clarkston, MI (US)

(72) Inventor: Christopher J. Newell, Clarkston, MI (US)

( * ) Notice: Subject to any disclaimer, the term of this patent is extended or adjusted under 35 U.S.C. 154(b) by 0 days.

(21) Appl. No.: 17/162,832

(22) Filed: Jan. 29, 2021

(65) Prior Publication Data

US 2021/0228958 A1 Jul. 29, 2021

Related U.S. Application Data

(60) Provisional application No. 62/967,260, filed on Jan. 29, 2020.

(51) Int. Cl.
*A63B 69/00* (2006.01)
*A63B 102/18* (2015.01)

(52) U.S. Cl.
CPC ..... *A63B 69/0002* (2013.01); *A63B 69/0075* (2013.01); *A63B 2069/0008* (2013.01); *A63B 2102/18* (2015.10); *A63B 2209/10* (2013.01)

(58) Field of Classification Search
CPC ..... A63B 69/0002; A63B 69/0075; A63B 2102/18; A63B 2069/0008; A63B 2209/10
USPC ..... 473/422, 458, 450
See application file for complete search history.

(56) References Cited

U.S. PATENT DOCUMENTS

| | | | | | |
|---|---|---|---|---|---|
| 3,529,823 | A * | 9/1970 | Garver | A63B 69/0075 | 473/418 |
| 4,303,247 | A * | 12/1981 | Fain | A63B 65/125 | 473/511 |
| 4,971,334 | A * | 11/1990 | Stewart | A63B 43/005 | 473/573 |
| 5,213,324 | A * | 5/1993 | Bowers | A63B 69/0002 | 473/457 |
| 6,896,631 | B1 * | 5/2005 | Fairchild | A63B 69/0002 | 473/422 |
| 8,986,139 | B1 * | 3/2015 | Gideon | A63B 69/3608 | 473/438 |
| 2003/0148833 | A1 * | 8/2003 | O'Hara | A63B 69/0059 | 473/458 |
| 2009/0082140 | A1 * | 3/2009 | Liao | A63B 69/0002 | 473/417 |
| 2013/0296080 | A1 * | 11/2013 | Sofka | A63B 63/06 | 473/453 |
| 2013/0324331 | A1 * | 12/2013 | Barnhill | A63B 69/0059 | 473/458 |
| 2016/0236052 | A1 * | 8/2016 | Sunday | A63B 69/00 | 473/458 |
| 2021/0138327 | A1 * | 5/2021 | Umland | A63B 69/0002 | 473/458 |

* cited by examiner

*Primary Examiner* — Mitra Aryanpour
(74) *Attorney, Agent, or Firm* — Harness, Dickey & Pierce, PLC

(57) ABSTRACT

The present disclosure provides a method for batting practice. The method includes securing a baseball training device to a leg of a user; positioning a stand assembly adjacent to the user; and swinging a baseball bat such that a ball positioned on the stand assembly attaches to the plate of the device. The device includes a body and a plate attached to and extending outwardly from the body.

14 Claims, 5 Drawing Sheets

BATTING TRAINING SYSTEM

CROSS-REFERENCE TO RELATED APPLICATIONS

This application claims the benefit of U.S. Provisional Application No. 62/967,260 filed on Jan. 29, 2020. The entire disclosure of the above application is incorporated herein by reference.

FIELD

The present disclosure relates to a batting training system.

BACKGROUND

This section provides background information related to the present disclosure and is not necessarily prior art.

Proper swinging mechanics in baseball are imperative to give the hitter a better chance of success at each at bat. It is known that hip rotation and follow through during a swing of a baseball bat is needed to achieve a batter's hitting potential. Many systems have been developed to train a batter to hit a baseball correctly and to teach proper hip rotation. However, such systems are difficult to transport, expensive, and ineffective in ensuring proper hip rotation and follow through. The present disclosure provides a system and method that is simple to use, inexpensive, and effective in ensuring hip rotation and follow through.

SUMMARY

This section provides a general summary of the disclosure, and is not a comprehensive disclosure of its full scope or all of its features.

The present disclosure provides a method for batting practice. The method includes securing a baseball training device to a leg of a user; positioning a stand assembly adjacent to the user; and swinging a baseball bat such that a ball positioned on the stand assembly attaches to the plate of the device. The device includes a body and a plate attached to and extending outwardly from the body.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Figure 5:
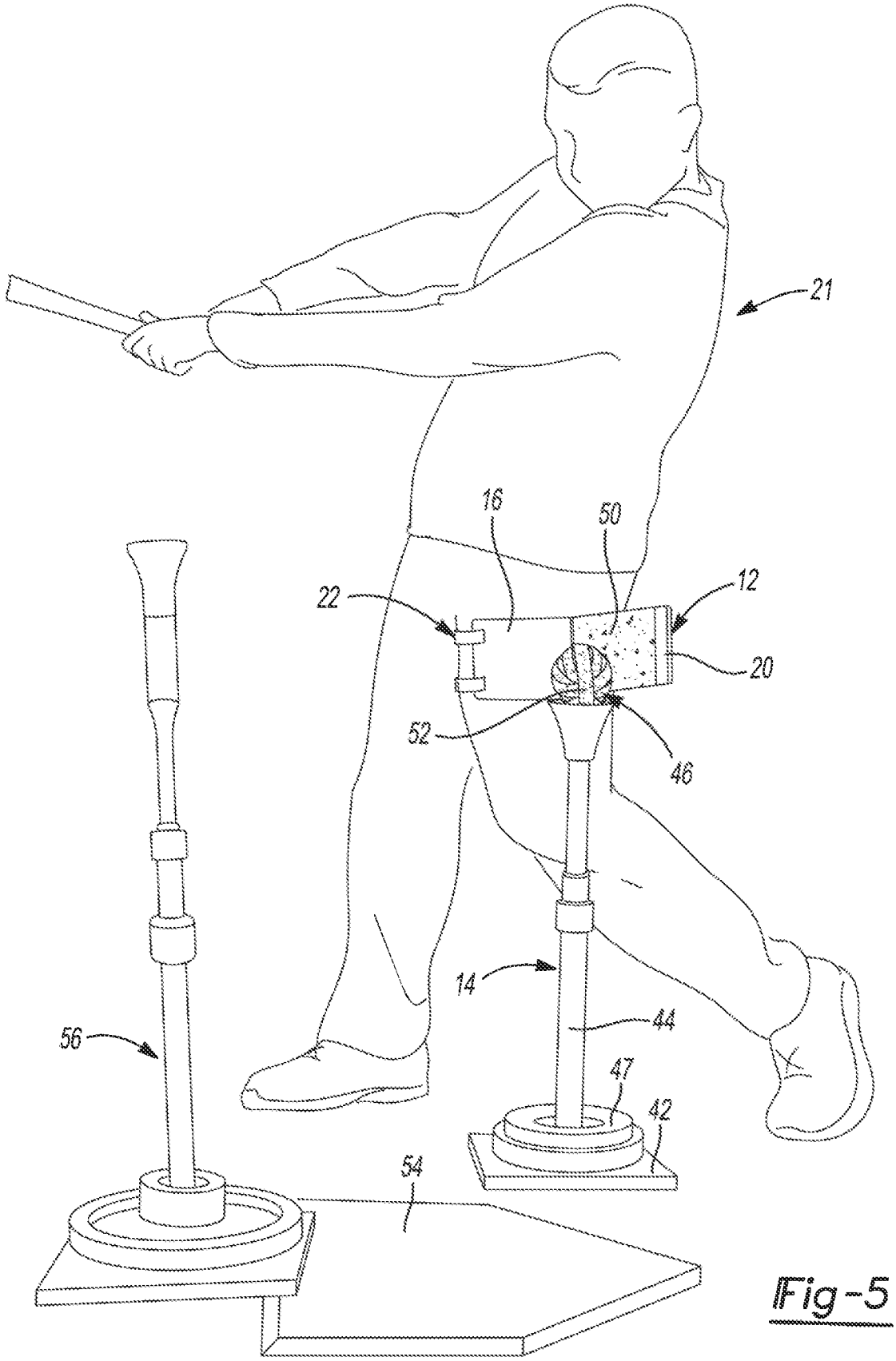
Figure 6:
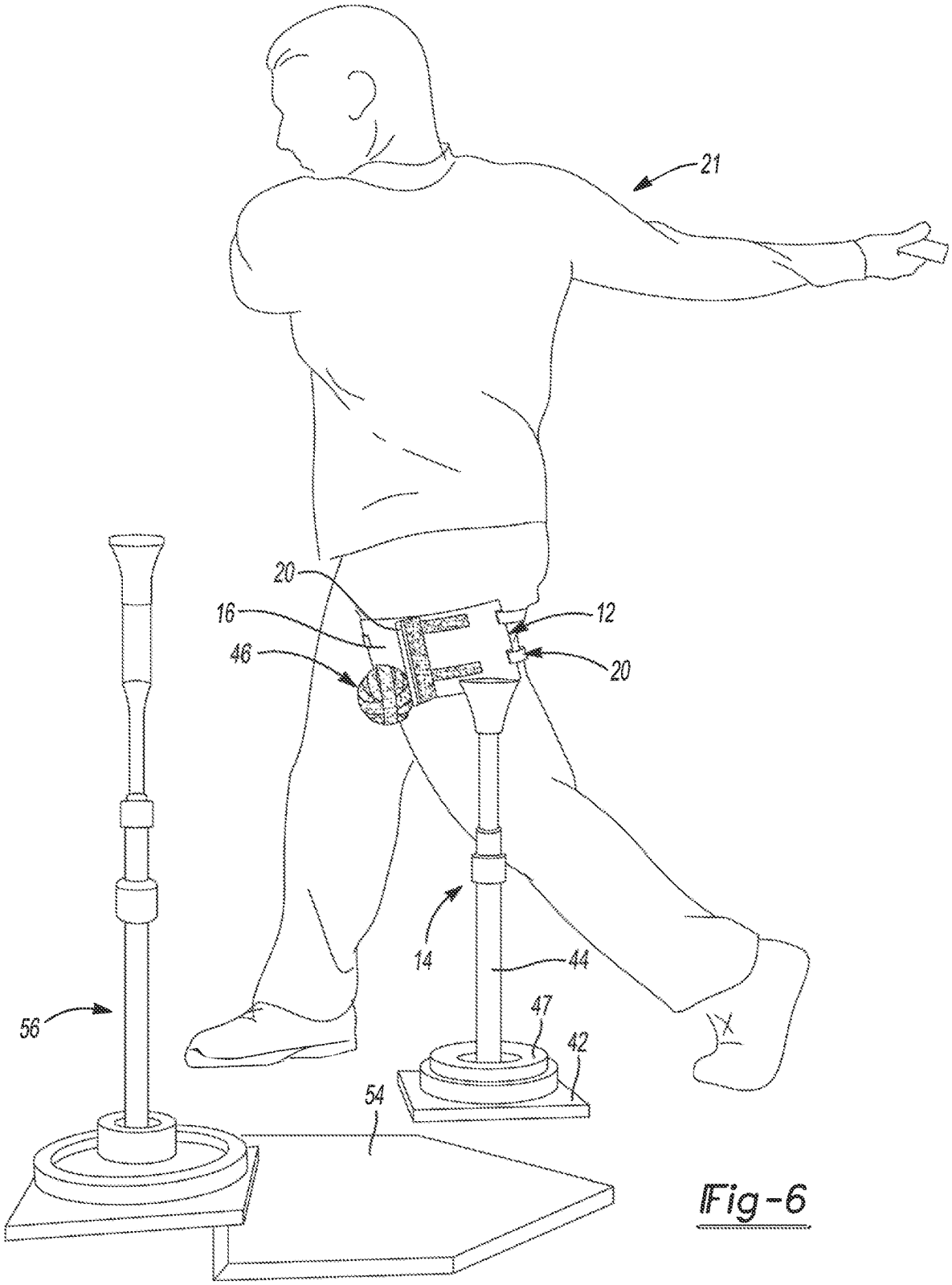

FIG. 5 is a perspective view of the batting training system showing a user swinging a baseball bat and prior to the batting training device contacting a ball positioned on a stand assembly of the system; and FIG. 6 is a perspective view of the batting training system showing a user swinging the baseball bat and after the batting training device attaches to the ball positioned on the stand assembly.

Corresponding reference numerals indicate corresponding parts throughout the several views of the drawings.

DETAILED DESCRIPTION

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

With reference to FIGS. 1-6, a batting training system 10 is provided. The training system 10 may be used by users (i.e., baseball players) to improve their swinging mechanics during batting practice, for example. The training system 10 may include a batting training device 12 and a stand assembly 14.

With reference to FIGS. 1-6, the training device 12 may include an arcuate body 16, a bracket 18 (FIGS. 1-3), a plate 20 and a plurality of straps 22. The body 16 may correspond to a user's 21 upper leg area 23 (e.g., the thigh area) and may be made of a rigid material such as a polymeric or metallic material, for example. The body 16 may define a first pair of slots 24*a*, 24*b* at a first end 26 and a second pair of slots at a second end 28 that is opposite the first end 26. The first pair of slots 24*a*, 24*b* may extend through the body 16 and may be spaced apart from each other. That is, the slot 24*a* may be positioned at or near an upper side of the body 16 and the slot 24*b* may be positioned at or near a lower side of the body 16. The second pair of slots may extend through the body 16 and may also be spaced apart from each other. That is, one of the slots may be positioned at or near the upper side of the body 16 and the other slot may be positioned at or near the lower side of the body 16.

The U-shaped bracket 18 may be attached to a middle portion of the body 16 (via fasteners (not shown)) and may be made of a metallic or polymeric material, for example. The bracket 18 may include an intermediate member 30 and end members 32*a*, 32*b*. The end members 32*a*, 32*b* may extend perpendicular to the intermediate member 30 and may cooperate with the intermediate member 30 to define a recess 34 (FIGS. 1 and 3) that extends the entire length of the bracket 18. Each end member 32*a*, 32*b* includes a plurality of apertures (not shown) extending there through. The apertures of the end member 32*a* are spaced apart from each other and are align with corresponding apertures of the end member 32*b*.

The plate 20 may be received in the recess 34 of the bracket 18 and may be attached to the bracket 18. The plate 20 may be made of a rigid material such as a polymeric of metallic material, for example. The plate 20 may extend outwardly from the body 16 away from the user's leg. Stated differently, the plate 20 may extend perpendicularly to a line extending tangent to the body 16.

The plate 20 may be planar and may include a first surface 36 and a second surface 38 that is opposite the first surface 36. The plate 20 may also include a plurality of openings extending there through. The openings may be align with corresponding apertures of the end member 32*a* and corresponding apertures of the end member 32*b*. In this way, fasteners 39 (e.g., bolts, rivets, screws, etc.) may extend through the openings of the plate 20, apertures of the end member 32*a* and apertures of the end member 32*b*, thereby, coupling the plate 20 and the bracket 18 to each other. In some configurations, the plate 20 may be removably coupled to the bracket 18 to facilitate storage and shipment of the device 12.

A first strap 22*a* of the plurality of straps 22 may extend through the first slot 24*a* and through the second slot of the body 16 and may be configured to wrap around the leg of the user 21. Similarly, a second strap 22*b* of the plurality of straps 22 may extend through the first slot 24*b* and through the other second slot of the body 16 and may also be configured to wrap around the leg of the user 21. The first and second straps 22*a*, 22*b* are also configured to be attached to the body 16 via hook-and-loop fasteners, for example. That is, first and second tabs 40*a*, 40*b* (i.e., hook tabs) may be attached to a surface of the body 16 (via an adhesive) and a portion of each of the first and second straps 22*a*, 22*b* may be loops. When the straps 22*a*, 22*b* wrap around the user's leg, the first and second straps 22*a*, 22*b* are configured to contact the tabs 40*a*, 40*b*, respectively, thereby creating a strong bond there between. In this way, the device 12 is securely coupled to the user's leg.

Figure 1:
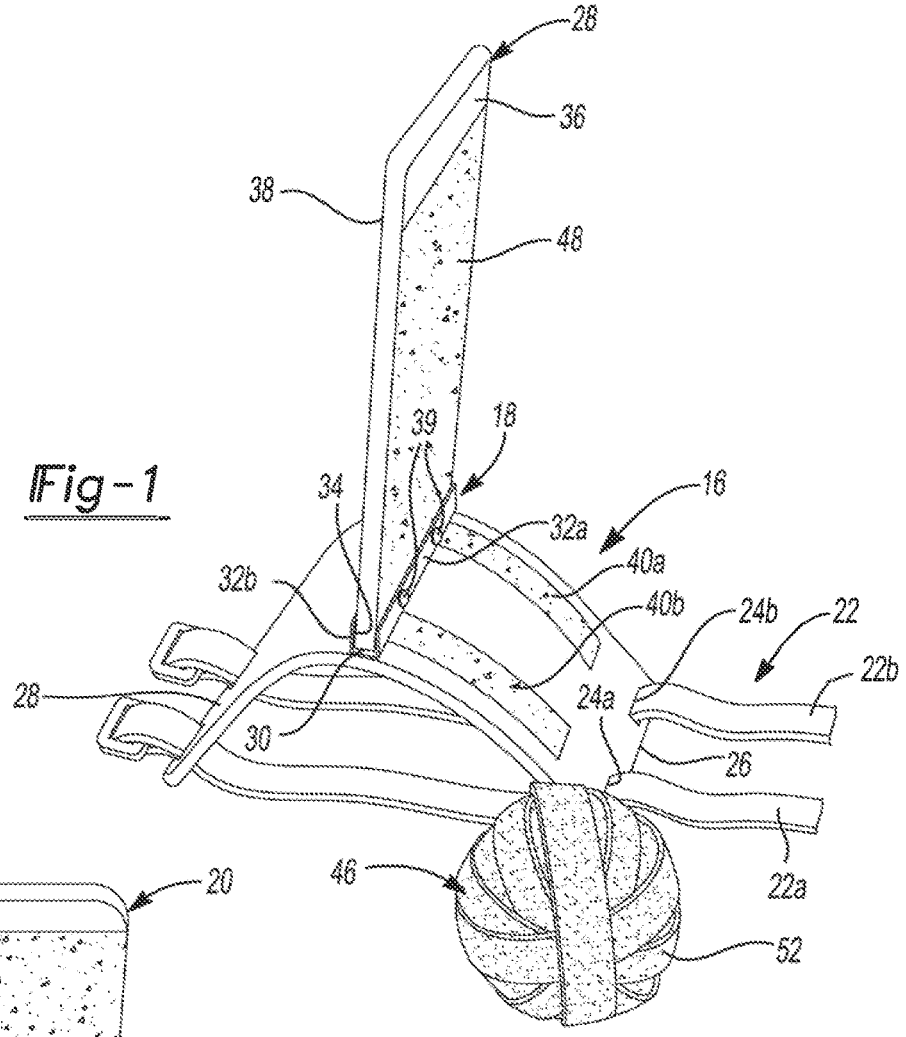
FIG. 1 is a perspective view of a batting training device of the batting training system according to the principles of the present disclosure.
Figure 2:
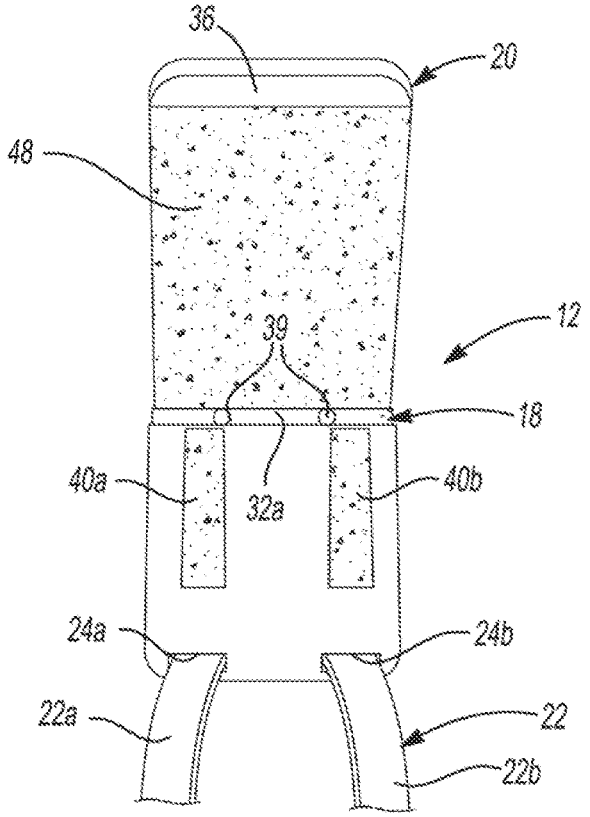
FIG. 2 is another perspective view of the batting training device.
Figure 3:
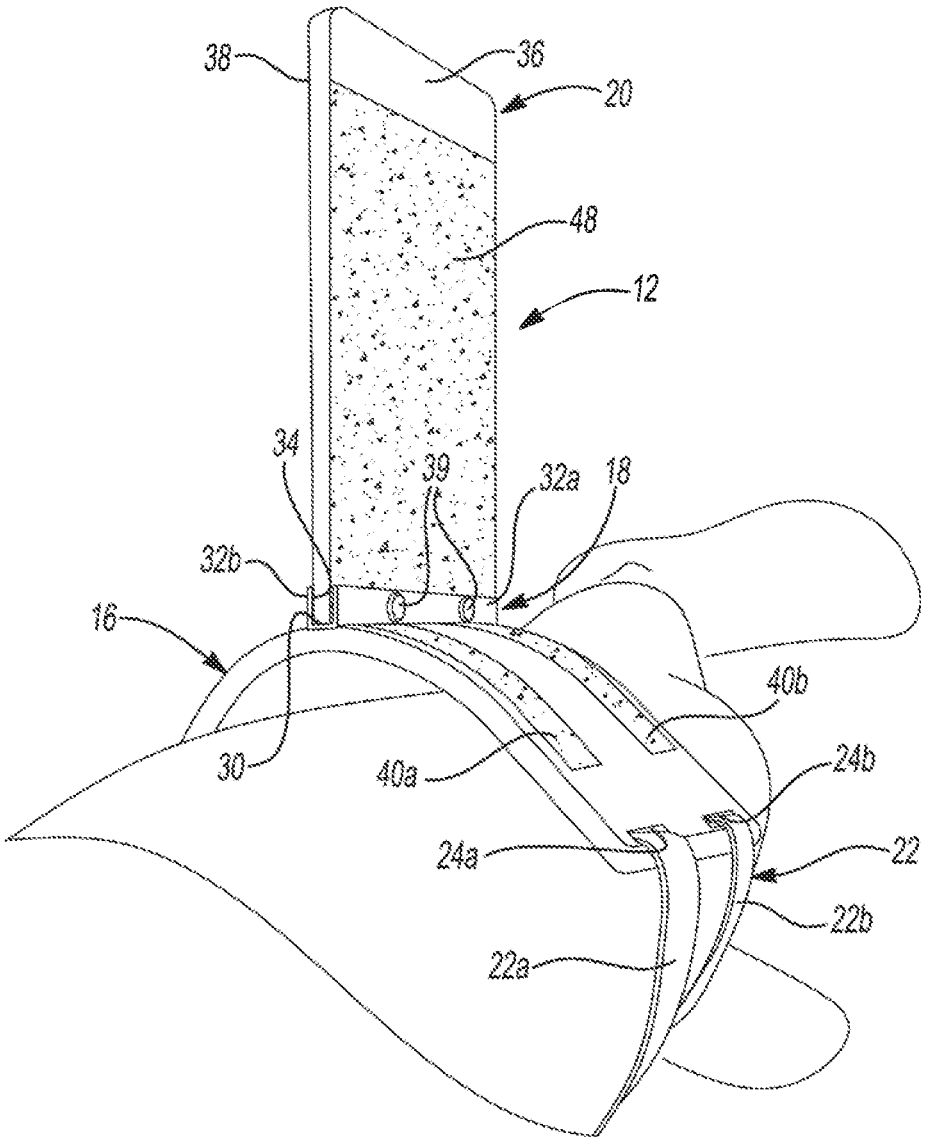
FIG. 3 is a perspective view of the batting training device coupled to a user's leg.
Figure 4:
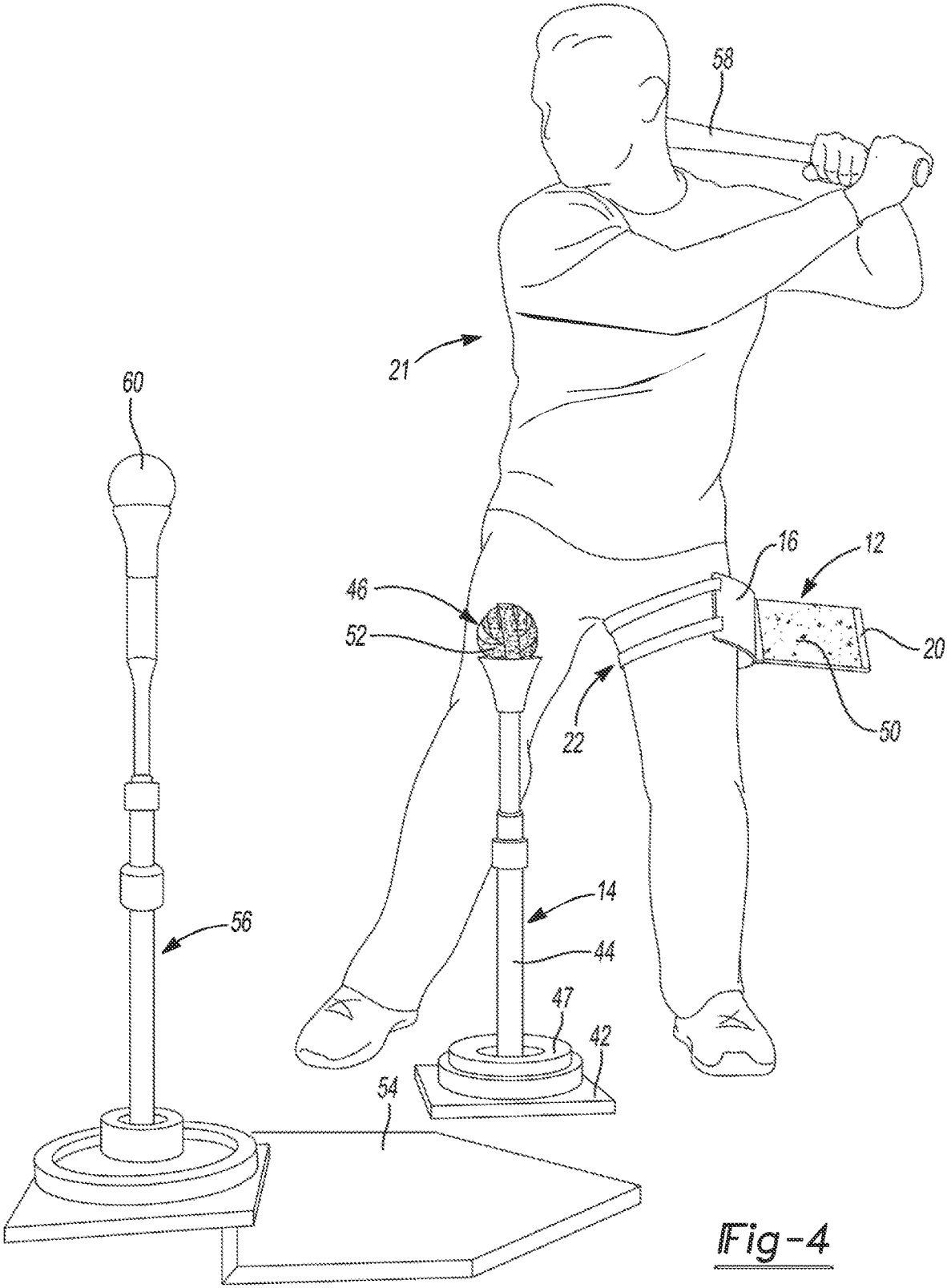
FIG. 4 is a perspective view of the batting training system showing a user in a batting position.

As shown in FIGS. 4-6, the stand assembly 14 may include a base 42, an elongated post 44 and a ball 46. The base 42 may be positioned on a surface and is held stationary by weights 47 disposed thereon. The post 44 may extend upwardly from the base 42 and may include an end that supports the ball 46 thereon. The ball 46 may be removably supported on the post 44 and may be configured to attach to the plate 20 of the device 12 using VELCRO, for example, when the user 21 is taking batting practice using the proper swinging motion. A first attachment pad 48 (e.g., loop fastener) may be attached to the first surface 36 of the plate 20 and may substantially cover (75%-95% cover) the first surface 36 of the plate 20. Similarly, a second attachment pad 50 (e.g., loop fastener) may be attached to the second surface 38 of the plate 20 and may substantially cover (75%-95% cover) the second surface 38 of the plate 20. The ball 46 may be covered with hook fasteners 52 such that the ball 46 is configured to attach to one of the first and second attachment pads 48, 50 when the user 21 is taking batting practice and using the proper swinging motion.

With continued reference to FIGS. 1-6, operation of the system 10 will now be described in detail. First, as show in FIG. 4, the user 21 securely attaches the device 12 to his or her upper leg area 23 as described above and positions the stand assembly 14 between him or her and home plate 54 (or a batting tee 56 or any other location that a baseball is being thrown). It should be noted that the device 12 may be secured to the upper leg area 23 of the user 21 such that the first attachment pad 48 is configured to attach to the ball 46 or the second attachment pad 50 is configured to attach to the ball 46.

Next, as shown in FIGS. 5 and 6, the user 21 swings a baseball bat 58 at a baseball 60 on the batting tee 56 (or being thrown by a pitcher (not shown)) such that the user's 21 backside (and hips) rotates through the ball 46 disposed on the post 44 and the ball 46 attaches to one of the first and second attachment pads 48, 50. That is, the device 12 ensures that the user 21 properly rotates his or her backside during the swing such that the ball 46 attaches to one of the first and second attachment pads 48, 50. Stated differently, if the user 21 slides forward during the swing such that his or her backside is not properly rotated through the swing, the ball 46 will not attach to one of the first and second attachment pads 48, 50, thereby signaling to the user 21 an improper swing.

One of the benefits of the system 10 of the present disclosure is that a user 21 is able to properly work and get real time feedback on his or her swinging mechanics. That is, if the user 21 swings the bat such that his or her backside is properly rotated, the ball 46 will attach to the one of the first and second attachment pads 48, 50, thereby signaling to the user 21 a good swing.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A method comprising:

securing a training device to a leg of a user, the training device including a plate attached to and extending outwardly from the leg of the user;

positioning a stand assembly adjacent to the user, the stand assembly having a removably positioned object thereon; and swinging a bat such that the plate contacts the removably positioned object and dislodges the removably positioned object from the stand assembly.

2. The method of claim 1, wherein the removably positioned object is a ball.

3. The method of claim 1, wherein the plate includes at least one surface and a first attachment material on said surface, and the removably positioned object includes a second attachment material, wherein the first and second attachment materials cooperate to removably attach the removably positioned object to the surface of the plate when the plate comes into contact with the removably positioned object.

4. The method of claim 3, wherein the first and second attachment materials comprise hook and loop fasteners.

5. The method of claim 1, wherein securing the training device to the leg of the user comprises securing the training device to the thigh portion of the leg of the user, and the stand assembly elevates the removably positioned object above the ground a distance that approximates the distance between the ground and the training device when secured to the thigh portion of the leg of the user.

6. The method of 1, wherein the training device further comprises:

an attachment material on a first surface of the plate, the attachment material having an outer surface that is configured to attach to the removably positioned object on contact; and a wrap assembly attached to the plate and configured to adjustably encircle the leg of the user to position the plate such that the plate extends outward from the leg of the user, about perpendicular to the leg of the user and about perpendicular to the ground when the user is in a standing position.

7. The method of claim 6, wherein the attachment material is one of a hook fastener and a loop fastener.

8. The method of claim 6, wherein the wrap assembly attached to the plate includes a rigid body portion that is contoured to approximate the shape of a portion of a circumference of the user's leg and at least one strap attached to the body portion and configured to adjust the circumference of the wrap assembly.

9. The method of claim 8, wherein the plate is rigidly attached to the body portion so as to maintain a substantially rigid perpendicular relationship between the plate and the body portion at the point of attachment.

10. A method comprising:

securing a training device to a leg of a user, the training device including a plate attached to and extending outwardly from the leg of the user, the plate including at least one surface and a first attachment material on said surface;

positioning a stand assembly adjacent to the user, the stand assembly having a removably positioned object thereon, wherein the removably positioned object includes a second attachment material; and swinging a bat such that the plate contacts the removably positioned object and dislodges the removably positioned object from the stand assembly and the first and second attachment materials cooperate to removably attach the removably positioned object to the surface of the plate.

11. The method of claim 10, wherein the removably positioned object is a ball.

12. A method comprising:

obtaining a training device comprising:

a plate that is attachable to a leg of a user, the plate having a first surface and a second surface on opposite sides of the plate, the first surface of the plate having an attachment material thereon; and a wrap assembly attached to the plate and configured to adjustably encircle the leg of the user to position the plate such that the plate extends outward from the leg of the user, the wrap assembly including a rigid body portion that is contoured to approximate the shape of a portion of a circumference of the user's leg and at least one strap attached to the body portion and configured to adjust the circumference of the wrap assembly;

securing the training device to the leg of the user such that the plate extends outwardly from the leg of the user;

positioning a stand assembly adjacent to the user, the stand assembly having an object removably positioned thereon; and swinging a bat such that the plate contacts the removably positioned object and dislodges the removably positioned object from the stand assembly and the attachment material on the first surface of the plate attaches to the removably positioned object upon contact.

13. The method of claim 12, wherein the removably positioned object is a ball.

14. The method of claim 12, wherein securing the training device to the leg of a user including positioning the plate about perpendicular to the leg of the user and about perpendicular to the ground when the user is in a standing position.

* * * * *